United States Patent [19]

Rousseau

[11] Patent Number: 4,706,477

[45] Date of Patent: Nov. 17, 1987

[54] KEY RING TYPE DEVICE

[76] Inventor: Jean-Pierre Rousseau, 96, Rue de Miromesnil, 75008 Paris, France

[21] Appl. No.: 20,305

[22] Filed: Mar. 2, 1987

[51] Int. Cl.[4] ..... B25B 33/00

[52] U.S. Cl. ..... 70/456 R; 81/485

[58] Field of Search ..... 70/456 R, 458, 456 B, 70/457, 458, 459; 81/485, 486, 488; D3/61, 62, 63, 64; 7/166, 169, 170; 29/239, 270

[56] References Cited

U.S. PATENT DOCUMENTS

| | | | |
|---|---|---|---|
| 3,263,804 | 8/1966 | Marenchin | 70/456 R |
| 4,325,273 | 4/1982 | Gibbons | 81/485 |
| 4,543,860 | 10/1985 | Van Meter | 70/456 R |

*Primary Examiner*—Robert L. Wolfe

*Attorney, Agent, or Firm*—Wolder, Gross & Yavner

[57] ABSTRACT

A key ring device comprising a jointed ring which can be drawn apart to allow insertion of a key or other object and an accessory part hanging from the ring. The accessory part includes a tool component to separate the ring loops and a guard member surrounding the tool to protect the user from the tool.

12 Claims, 4 Drawing Figures

KEY RING TYPE DEVICE

The present invention pertains to key ring type devices of the type which comprise a ring with jointed helicoidal turns which can be drawn apart along a direction parallel to that of the turns' axis so as to allow the insertion of the edge of the hook opening of an object, such as a key, and an accessory part hanging from the ring to create bulk for the key ring ensemble and to carry inscriptions or indicia if so desired.

Such devices, particularly key ring devices, allow for very secure fastening of keys thanks to the above described ring. Insertion of objects, however, into the turns of the ring is not always easily achieved. Practically speaking, one is faced with two contradictory requirements: On the one hand, the turns of the ring should offer heightened resistance to separation along the direction parallel to the axis of the turns so that the keys are securely hooked. On the other hand, so as to ease the ring in the hook opening, the user should be able to easily draw the turns apart along a direction parallel to their own axis.

Accordingly, an object of the present invention is to provide a key ring device such as the one described above that would best meet the various practical requirements, and which, among other things, while still providing secure fastening, will also allow for an easier placing of the ring in the hook openings of objects, and particularly keys.

In accordance with the invention, the key ring type device of the present invention comprises a ring with jointed helicoidal turns that can be drawn apart along a direction parallel to the axis of the turns so as to allow the insertion of the edge of the hook opening of an object such as a key, and an accessory part hanging from this ring to create bulk for the key ring ensemble and also to carry inscriptions if so desired. The accessory part includes a component designed as a tool to draw the turns of the ring apart for the hooking of a key, this component being positioned on said part so that it can be pressed between two turns to separate them, said part also including a guard band enclosing the tool component, protecting the environment from the tool component, this guard band enclosing the tool being also used to hook said ring onto said part. The tool component may be positioned on said part so that it rests on the exterior area of the ring, and preferably comprises a slender pointed extemity or equivalent to separate the turns.

The tool component can be approximately flat; the pointed end can be defined by the two sides of a dihedron, the point of this end being the solid angle of intersection of these two sides. Alternatives embodiments may include a pointed end in a conical or truncated conical shape.

The above mentioned accessory part may include, at one end, an opening to hook on the ring, the edge of this opening forming the guard band, the tool component projecting radially into this opening in the direction of the edge of this opening, which also constitutes the extremity of the accessory part. The tool component is contained within the same plane as the opening.

The accessory part can be flat, the axis of the aforesaid tool component approximately contained within the plane of the accessory part so that when said part is being inserted between the turns of the ring, the plane containing the ring is perpendicular to that containing the accessory part. The opening, of which the edge constitutes the guard band of the accessory part, can be positioned directly on the accessory part.

As a variation, this opening can be formed from a U-shaped member, the end of the branches farthest from the bottom of the U being connected to one another by a block. The end of the block closest to the bottom of the U supports the above mentioned tool component with its pointed extremity directed towards the concave side of the U. The tool component can be made of metal, sufficiently rigid plastic material, or any other appropriate material.

The foregoing features, along with additional features and advantages of the present invention, will become apparent upon review of the following descriptions of preferred, illustrative embodiments of the invention taken in conjunction with annexed figures, wherein.

Figure 2:
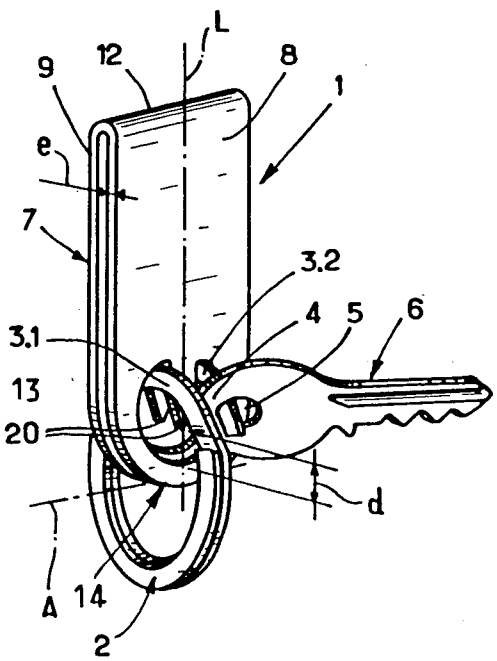
FIG. 2 is another top perspective view, illustrating the hooking to the ring of the device described in FIG. 1.
Figure 1:
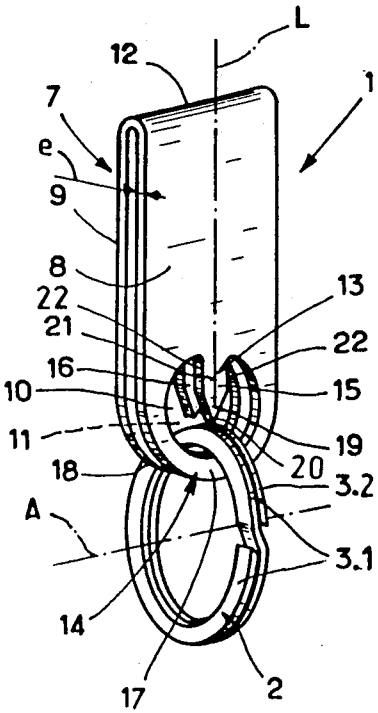
FIG. 1 is top perspective view of a key ring type device corresponding to the invention.

According to the drawing, specifically FIGS. 1 and 2, the key ring device 1 includes, on one hand, a ring 2 with jointed helicoidal turns 3.1 and 3.2 that can be drawn apart along a direction parallel to axis A of the turns (see FIG. 2) so as to allow the insertion of the edge 4 of the hook opening 5 of a key 6. Accessory part 7 is inserted upon and hangs from ring 2.

The accessory part 7 is designed, among other things, to create bulk for the key ring ensemble and to facilitate its gripping. The accessory part 7 may also carry inscriptions or indicia, such as advertisements or ownership information.

According to the specific embodiment depicted in FIGS. 1 and 2, the accessory part 7 is flat in shape and comprises two flat wings 8 and 9, which are approximately parallel, one end of which defines a pair of circular openings 10, 11 for hook ring 2. The openings 10 and 11 lay superimposed along a direction perpendicular to the plane containing wings 8 and 9. These wings are generally rectangular in shape, the ends with the openings 10, 11 being rounded. The two wings are bound to one another by a zone 12 at the extremity opposite the openings 10, 11. Such an accessory part 7 can be made of a metal sheet doubled in the shape of a narrow U.

The above mentioned accessory part 7 includes a section 13 designed as a tool component to drawn turns 3.1 and 3.2 of the ring apart so as to hook the key 6, this tool component 13 being positioned on said part so that it can engage turns 3.1, 3.2 where they can be separated. Accessory part 7 also includes a guard band 14, this guard band 14 enclosing the tool component and being used to hook and maintain ring 2 to part 7. The tool component 13 is positioned on the accessory part 7 so that it rests on the exterior area of the ring 2 as seen in FIGS. 1 and 2, and comprises the set of the two strips 15, 16 of wings 8 and 9, strips 15 and 16 projecting themselves radially respectively into openings 10, 11. The strips 15 and 16 lay directly opposite edges 17, 18 of the openings 10 and 11 that make up the extremities of the wings 8 and 9.

Each strip 15, 16 of the tool component 13 comprises a slender pointed end 19 with a point 20, or equivalent, to draw the turns apart. This end 19 is defined by the two sides of a dihedron and the point 20 is the solid angle of intersection of these two sides. The width of the two sides is equal to the thickness e of the wings 8 and 9.

The axis of each trip 15, 16 is approximately contained within the plane of each wing 8 and 9 and is directed along one diameter of each corresponding circular opening 10, 11. This diameter is merged with the middle longitudinal axis such as axis L of each face 8, 9. Each strip 15, 16 comprises an area 21 stretching between the end 19 and the main portion of wings 8, 9 which is bounded by edges 22 parallel to one another, and, preferably, parallel to direction L.

As a variation, the strips 15, 16 forming the tool component 13 may be directed opposite the way depicted in FIGS. 1 and 2; in which case, the strips would be contiguous to a section of edges 17, 18 of the openings 10, 11 and would project into these openings towards area 12. The strips 15, 16 can also be positioned inside openings 10, 11 along any chosen radius of the openings.

A key 6 will be hooked to the ring 2 as follows: The plane containing the ring 2 is approximately perpendicular to the plane containing the accessory part 7. While holding part 7 in one hand and ring 2 in the other hand, the user presses points 20 against the exterior edges of the turns 3.1, 3.2, so as to insert points 20 between those two turns to create the spacing as depicted on FIG. 2.

The strips 15 and 16 are driven in between the two turns until parallel edges such as 22 of these strips are inserted between the turns. Because these edges run parallel, the grip action of the turns on the strips 15 and 16 does not cause any force along direction L on part 7 that would tend to drive component 13 out of the turns, as would be the case were this grip action to take place at the location of the slender extremity 19.

The user can then release part 7, which remains in the position where strips 15 and 16 are holding turns 3.1 and 3.2 apart. The user can thus take the key 6 in his available hand and insert the end of turn 3.2 into the opening 5 of the key 6.

When this insertion is made, the user can then free the strips 15 and 16 from the space in between the turns 3.1 and 3.2, so that the edge around the opening 5 of the key is held tight between these turns. It then suffices to move the key 6 along the turns until the opening 5 reaches the free extremity of the turn 3.1. The ring 2 is then completely inserted in the opening 5, as represented on FIG. 3 depicting the relative position of the key and ring.

Figure 3:
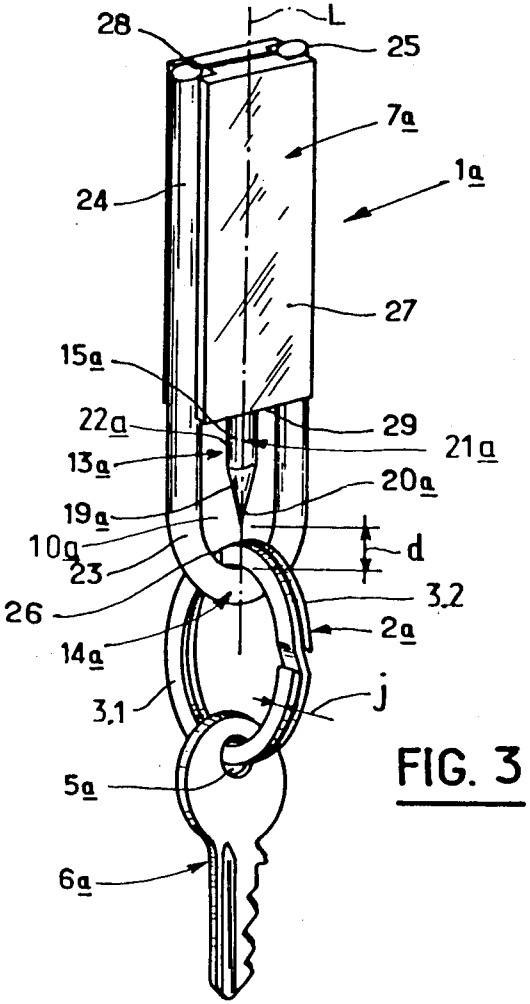
FIG. 3 is a top perspective view of an alternative key ring type device shown with a key hanging from the ring.

FIG. 3 illustrates a variation 1*a* of the key ring device consistent with the invention. The various parts of this device, similar in nature or in operation to parts already described with respect to FIGS. 1 and 2, are referred to with the same numbers accompanied by the letter a.

The accessory part 7*a* comprises a U-shaped bar 23, the ends of its branches or arms 24, 25 farthest from the bottom of the U being connected to one another by a block 27 approximately in the shape of a rectangle parallelepiped.

The bar 23 can be made of a metallic stock, preferably with a circular cross section, bent in the shape of the letter U; the block 27 can be made of two pieces assembled symetrically with respect to the plane containing the bar 23; the block 27 and the branches 24, 25 may be rigidly bound together by any appropriate means, such as glue.

The block 27 includes, at its end 29 directed towards the concave side of the U, component 13*a* to be used as a tool, of which point 20*a* faces the concave bottom 26 of the U. The longitudinal axis of this tool component 13*a* is merged with the longitudinal direction L of block 27 and is contained within the plane of branches 24, 25.

The slender extremity 19*a* is made of a conical or truncated conical area, the point or summit 20*a* being directed towards ring 2*a*.

The tool component 13*a* may be formed of a metallic stem mounted to the extremity 29 of the block 27 and rigidly bound to it. As a variation, this tool could be formed as an integral portion of block 27, and be made of an appropriate rigid plastic material.

In the example depicted in FIG. 3, the stem forming the tool 13*a* is cylindrical in the area stretching from the slender end 19*a* to the extremity 29 of the block 27. This cylindrical area 21*a* plays a part similar to that of area 21 of strips 15, 16 of FIGS. 1 and 2 as defined by the edges 22. It should be pointed out that this stem could have an hexagonal cross section, in which case the slender end 19*a* would assume the shape of a pyramid. Other cross sections may also be utilized.

Hooking a key 6*a* into the ring 2*a* is achieved under conditions similar to those described with reference to FIGS. 1 and 2, and thus does not warrant a repeat of the description.

Figure 4:
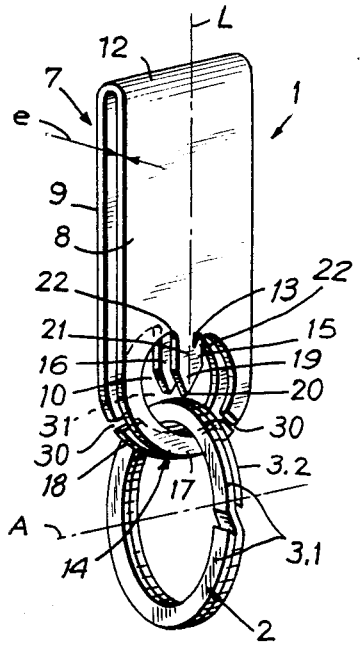
FIG. 4 is a perspective view of the tool component end of another alternative of the invention incorporating a pair of slots in the guard band.

As shown in FIG. 4, guard band 14 may be formed with a pair of slots 30 in wings 8 and 9. These slots are offset from each other, and facilitate the insertion of ring 2 within the guard band.

Attention should be given to the fact that each guard band 14 or 14*a* constitutes a protection within which the tool component 13 or 13*a* is inscribed, and which prevents any contact of this tool with the exterior, for example with a finger or with the fabric of the pocket where the key ring is being carried.

The distance d between the point 20 or 20*a* and the interior area facing the guard band 14, 14*a* is greater than the width j of the ring but is kept small enough so as to provide efficient protection, to prevent, for example, the introduction of a finger between the point and the guard band.

Clearly, numerous variations of the invention are possible. As an example, the device depicted in FIGS. 1 and 2 could be made entirely of sufficiently rigid plastic material, the accessory part 7 being formed of a single block together with the strips 15 and 16.

I claim:

1. A key ring type device comprising a ring with jointed helicoidal turns that can be drawn apart along a direction parallel to the axis of the turns so as to allow the insertion of the edge of the hook opening of an object such as a key, and an accessory part hanging from this ring to create bulk for the key ring ensemble and to carry inscriptions, said accessory part comprising a tool component portion to be used as a tool to separate the turns of the ring; said component being positioned on said accessory part such that it can be pressed between two turns of said ring to separate said turns, said accessory part further comprising a guard band surrounding said tool component, said guard band 14 enclosing the tool component and being further adapted to support said ring on said accessory part.

2. The device of claim 1 wherein said tool component is positioned on said accessory part so as to be insertable against the exterior area of said ring.

3. The device of claim 2 wherein said tool component comprises a slender extremity having means to draw the turns apart.

4. The device of claim 3 wherein said drawing means comprise a point on said slender extremity.

5. The device of claim 4 wherein said tool component is approximately flat in shape with a slender end defined by two sides of a dihedron, the point of said end being the solid angle of intersection of said two sides.

6. The device of claim 4 wherein said tool component comprises a slender end having a conical area.

7. The device of claim 4 wherein said accessory part comprises, at one end, a loop to hook said ring, the edge of said loop constituting said guard band, said tool component projecting radially into the opening of said loop towards the edge of said loop forming the extremity of said accessory part, said tool component being contained in a plane merged with the plane of said loop.

8. The device of claim 7 wherein said accessory part is flat in shape, the axis of said tool component being approximately contained within the plane of said accessory part so that the plane containing the ring is approximately perpendicular to that containing said part when tool is driven between the turns of the ring.

9. The device of claim 8 wherein said accessory part includes ring entry means.

10. The device of claim 9 wherein said ring entry means comprises slot means in said loop.

11. The device of claim 7 wherein said accessory part comprises a U-shaped bar comprising a pair of branches connected by a block, said bar supporting said tool component at its end closest to the botton of the U, the point of said tool component being directed towards the concave side of said U-shaped bar.

12. The device of claim 11 wherein said tool component includes a portion having parallel edges.

* * * * *